US009751684B2

(12) United States Patent
Chang et al.

(10) Patent No.: US 9,751,684 B2
(45) Date of Patent: Sep. 5, 2017

(54) BUBBLE LIQUID BOTTLE

(71) Applicant: KING QUANTA INDUSTRIAL CORPORATION LIMITED, New Taipei (TW)

(72) Inventors: Hao Chang, New Taipei (TW); Wen-Ling Lin, New Taipei (TW)

(73) Assignee: KING QUANTA INDUSTRIAL CORPORATION LIMITED, New Taipei (TW)

( * ) Notice: Subject to any disclaimer, the term of this patent is extended or adjusted under 35 U.S.C. 154(b) by 283 days.

(21) Appl. No.: 14/697,638

(22) Filed: Apr. 28, 2015

(65) Prior Publication Data

US 2016/0251143 A1 Sep. 1, 2016

(30) Foreign Application Priority Data

Feb. 26, 2015 (TW) ..... 104106326 A

(51) Int. Cl.
*B65D 83/70* (2006.01)
*B67D 1/04* (2006.01)
(Continued)

(52) U.S. Cl.
CPC ..... *B65D 83/70* (2013.01); *B65D 1/0207* (2013.01); *B65D 47/247* (2013.01);
(Continued)

(58) Field of Classification Search
CPC .. B65D 1/0207; B65D 47/247; B65D 83/202; B65D 83/70; B65D 85/72; B67D 1/0437; B67D 1/0456
See application file for complete search history.

(56) References Cited

U.S. PATENT DOCUMENTS 1,648,575 A * 11/1927 Campbell ..... B67D 1/0456 137/115.16
RE20,535 E * 10/1937 Hill, Jr. ..... B67D 1/0456 137/68.23
(Continued)

FOREIGN PATENT DOCUMENTS

CN 102934260 A 2/2013
CN 103129824 A 6/2013
(Continued)

*Primary Examiner* — Frederick C Nicolas
*Assistant Examiner* — Bob Zadeh
(74) *Attorney, Agent, or Firm* — Winston Hsu

(57) ABSTRACT

A bubble liquid bottle includes a bottle body, a pad covering a mouth of the bottle body, a straw connected to a communication opening of the pad and inserted into the bottle body, and a head. The head is disposed on the mouth and includes a main body having outlet, inlet, and communication channels, a handle, and a pressure-relief device disposed in the communication channel and including a stopper, an elastic member for driving the stopper to block communication between the outlet channel and the communication opening, and a ring located above the outlet channel and sleeving the stopper. The handle is pivoted to the main body and inserted into the stopper for moving the stopper upward. When an internal pressure of the bottle body is greater than a predetermined value, the stopper is moved upward by the internal pressure to make the outlet channel communicated with the communication opening.

10 Claims, 5 Drawing Sheets

(51) Int. Cl.

| | |
|---|---|
| ***B65D 1/02*** | (2006.01) |
| ***B65D 47/24*** | (2006.01) |
| ***B65D 83/20*** | (2006.01) |
| ***B65D 85/72*** | (2006.01) |

(52) U.S. Cl.
CPC ..... *B65D 83/202* (2013.01); *B65D 85/72* (2013.01); *B67D 1/0437* (2013.01); *B67D 1/0456* (2013.01)

(56) References Cited

U.S. PATENT DOCUMENTS

| | | | | | |
|---|---|---|---|---|---|
| 3,282,510 | A * | 11/1966 | Van Schwartz | B05B 9/0805 | 222/399 |
| 3,883,043 | A * | 5/1975 | Lane | B67D 1/0412 | 222/152 |
| 4,850,387 | A * | 7/1989 | Bassill | B67D 1/0412 | 137/212 |
| 6,279,787 | B1 | 8/2001 | Kim | | |
| 6,868,992 | B2 * | 3/2005 | Lasry | B05B 11/0032 | 222/400.8 |
| 8,353,418 | B2 | 1/2013 | Bork | | |
| 8,978,923 | B2 | 3/2015 | George | | |
| 9,181,021 | B2 * | 11/2015 | Manera | B65D 83/32 | |
| 2013/0098912 | A1 | 4/2013 | Scagliarini | | |
| 2014/0076173 | A1 * | 3/2014 | Pellaud | C12C 5/026 | 99/323.2 |

FOREIGN PATENT DOCUMENTS

| | | | | | |
|---|---|---|---|---|---|
| CN | 102398724 | B | | 1/2015 | |
| GB | 402353 | | | 11/1933 | |
| GB | 402353 | A | * | 11/1933 | B67D 1/0456 |
| GB | 650063 | A | * | 2/1951 | B65D 83/202 |
| JP | S61164 | A | | 1/1986 | |
| JP | 2001335057 | A | | 12/2001 | |
| TW | 516561 | | | 1/2003 | |
| TW | M478671 | | | 5/2014 | |

* cited by examiner

BUBBLE LIQUID BOTTLE

BACKGROUND OF THE INVENTION

1. Field of the Invention

The present invention relates to a bubble liquid bottle, and more specifically, to a bubble liquid bottle with a pressure-relief function.

2. Description of the Prior Art

In general, a bubble liquid bottle (e.g. a soda bottle) usually has a pressure-relief function. A conventional design is to dispose a piston between an outlet channel of the bubble liquid bottle and a straw opening of the bubble liquid bottle communicated with an internal space of the bubble liquid bottle and to sleeve a ring on the piston to be located under the outlet channel. Accordingly, when an internal pressure of the bubble liquid bottle is less than a predetermined value (e.g. 30 $Kg/cm^2$), the ring could block communication between the outlet channel and the straw opening for achieving the hermetic purpose. On the other hand, when the internal pressure of the bubble liquid bottle is greater than the predetermined value, the piston could be driven to move upward by the internal pressure of the bubble liquid bottle. Accordingly, with upward movement of the piston, the ring could move to be located above the outlet channel so as to make the straw opening communicated with the outlet channel for generating the pressure-relief effect. In such a manner, the internal pressure of the bubble liquid bottle could be reduced.

However, since the ring could be cut by a corner edge of the outlet channel when the ring moves with the piston, it may cause the problem that the ring could be cut off by the outlet channel after the bubble liquid bottle executes the pressure-relief function several times. Accordingly, the pressure-relief function of the bubble liquid bottle could lose its efficacy, so as to increase danger in use of the bubble liquid bottle.

SUMMARY OF THE INVENTION

The present invention provides a bubble liquid bottle including a bottle body, a pad, a straw, and a head. The bottle body has a mouth for containing liquid. The pad covers the mouth of the bottle body and has a communication opening. The straw is connected to the communication opening and inserted into the bottle body. The head is disposed on the mouth and covers the pad. The head includes a main body, a pressure-relief device, and a handle. The main body has an outlet channel, an inlet channel, and a communication channel. The outlet channel is communicated with the communication opening via the communication channel. The inlet channel is communicated with the communication channel, and is used for connecting to a gas filling bottle so as to make gas provided by the gas filling bottle enter the bottle body via the communication opening and then dissolve in the liquid contained in the bottle body to generate a bubble liquid. The pressure-relief device is disposed in the communication channel. The pressure-relief device includes a stopper, an elastic member, and a ring. The stopper is movably disposed in the communication channel. The elastic member is disposed in the communication channel and abuts against the stopper for providing an elastic force to drive the stopper to block communication between the outlet channel and the communication opening. The ring sleeves the stopper and is located above the outlet channel for preventing the bubble liquid or the liquid from overflowing out of the communication channel. The handle is pivoted to the main body and inserted into the stopper for moving the stopper upward along the communication channel when the handle is pressed so as to make the bubble liquid driven by an internal pressure of the bottle body to flow out of the outlet channel through the straw, the communication opening, and the communication channel. When the internal pressure of the bottle body is greater than a first predetermined value, the stopper is moved upward by the internal pressure of the bottle body to make the outlet channel communicated with the communication opening.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
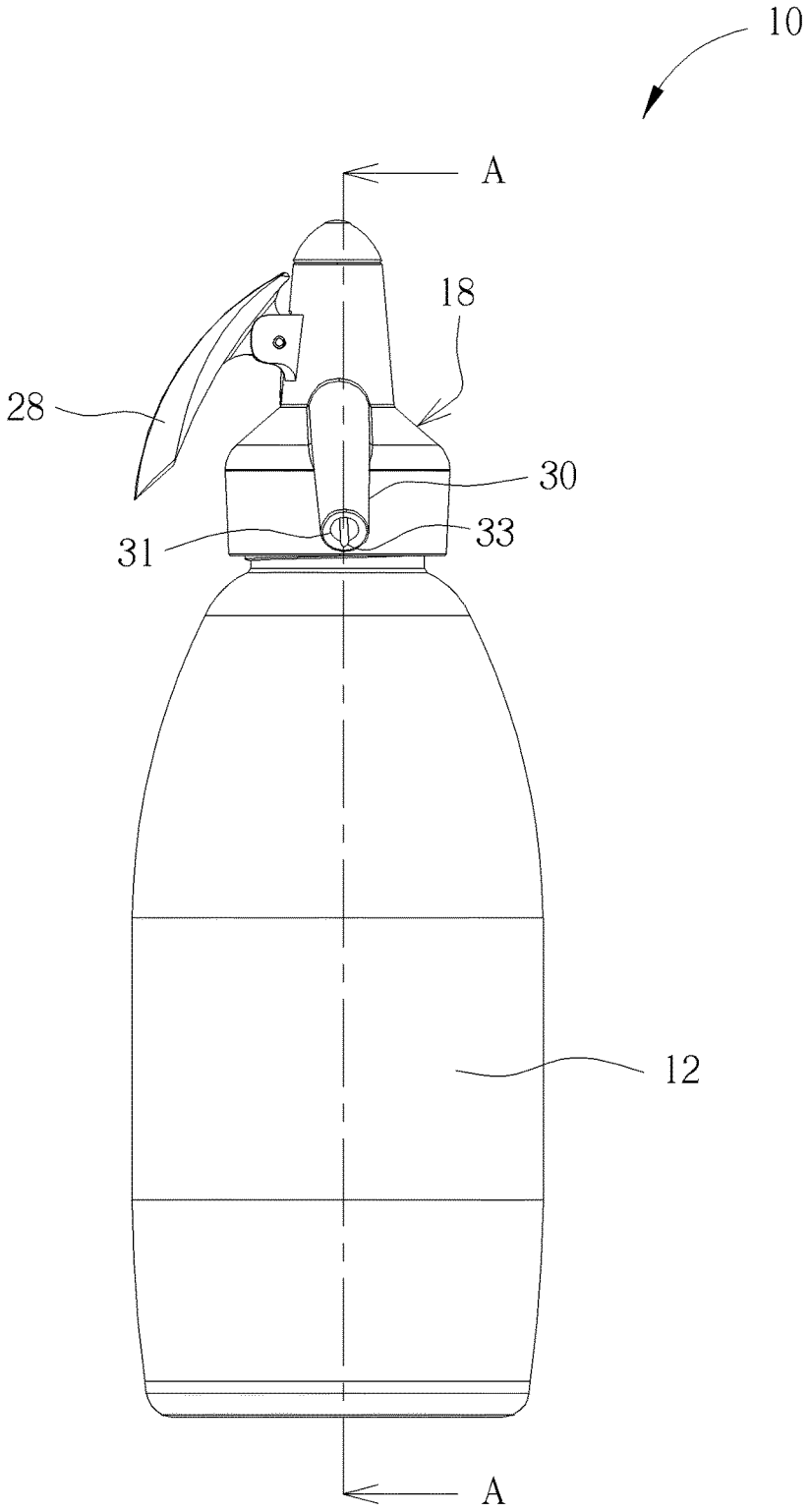
FIG. 1 is a front view of a bubble liquid bottle according to an embodiment of the present invention.
Figure 2:
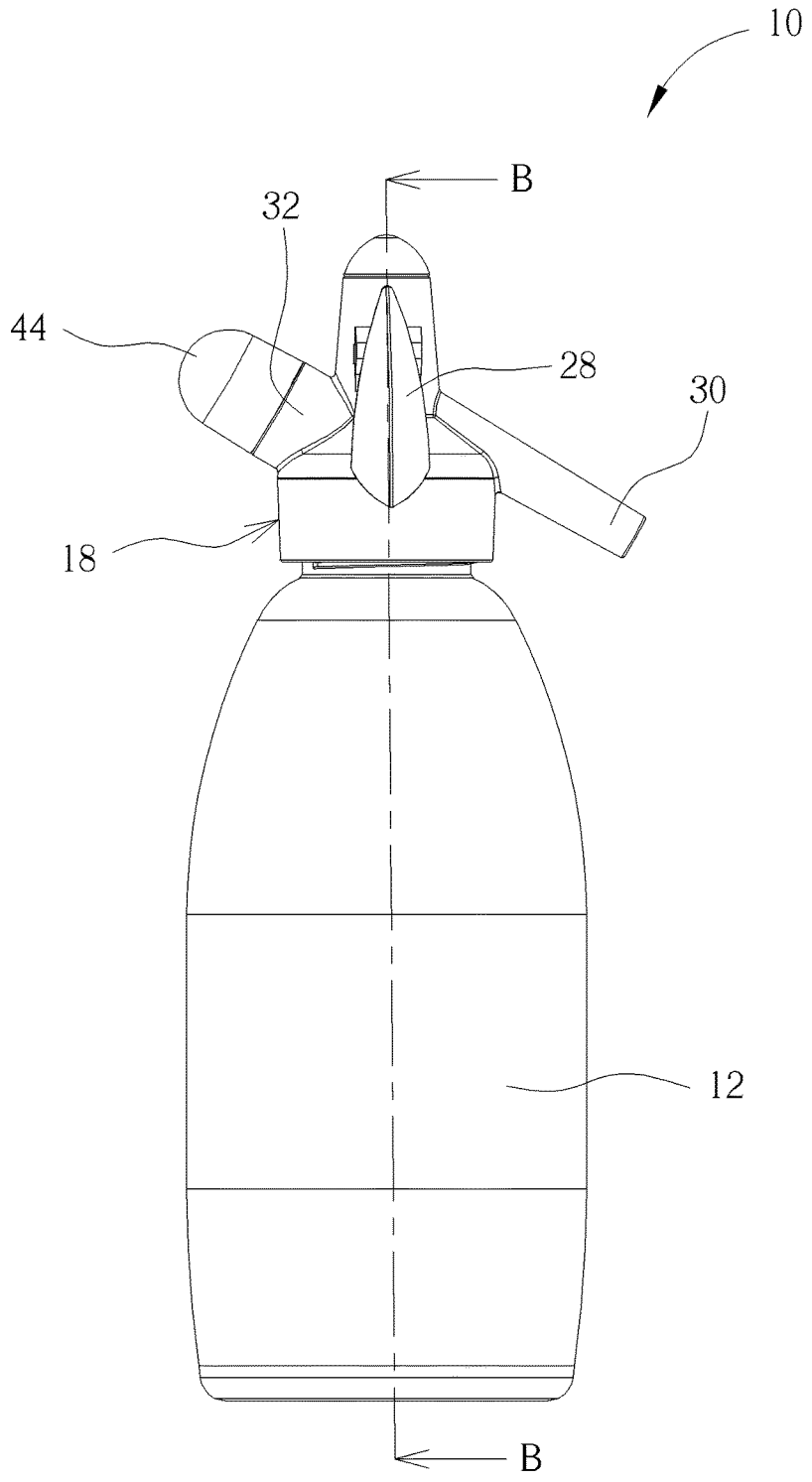
FIG. 2 is a side view of the bubble liquid bottle in FIG. 1.
Figure 3:
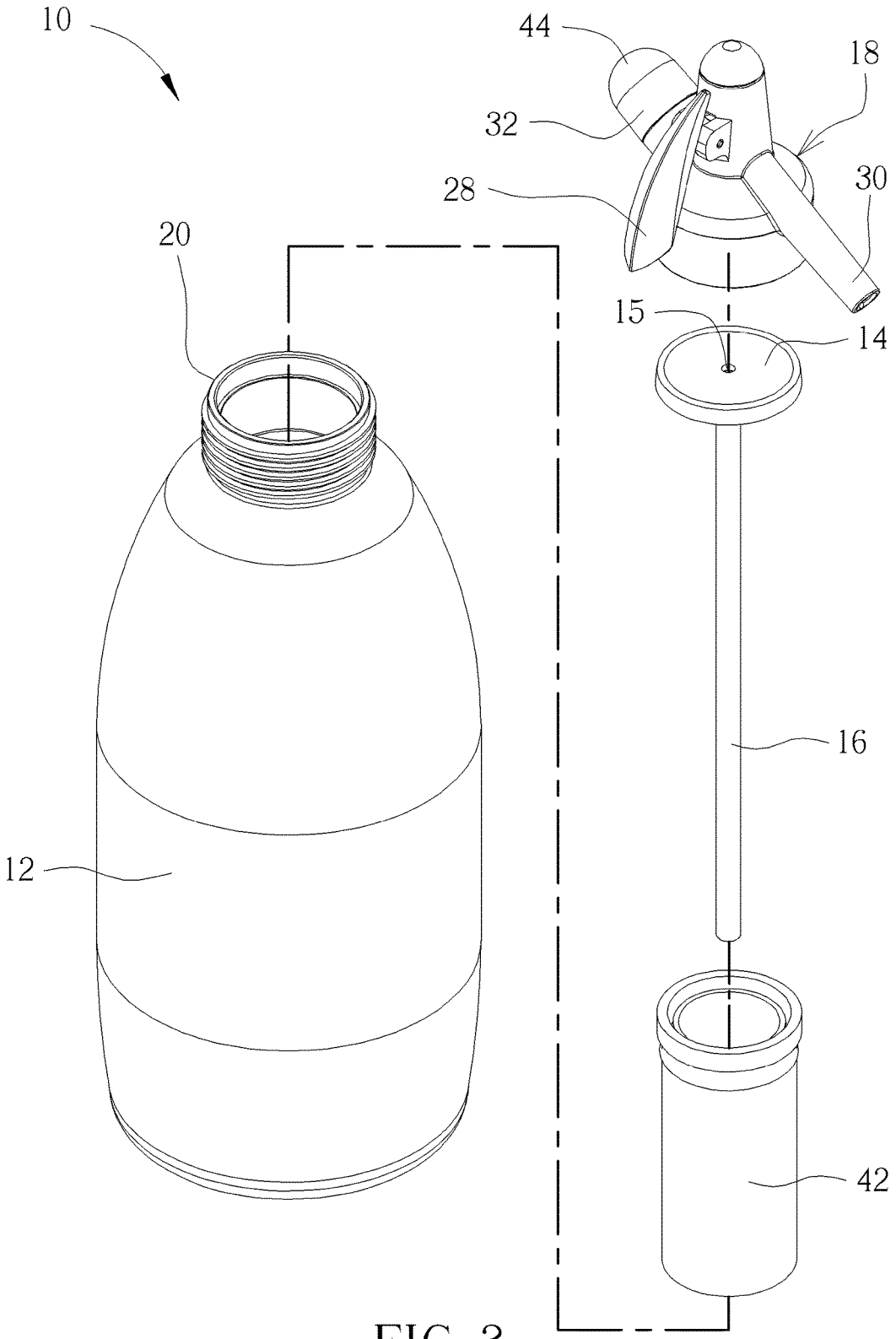
FIG. 3 is an exploded diagram of the bubble liquid bottle in FIG. 1.
Figure 4:
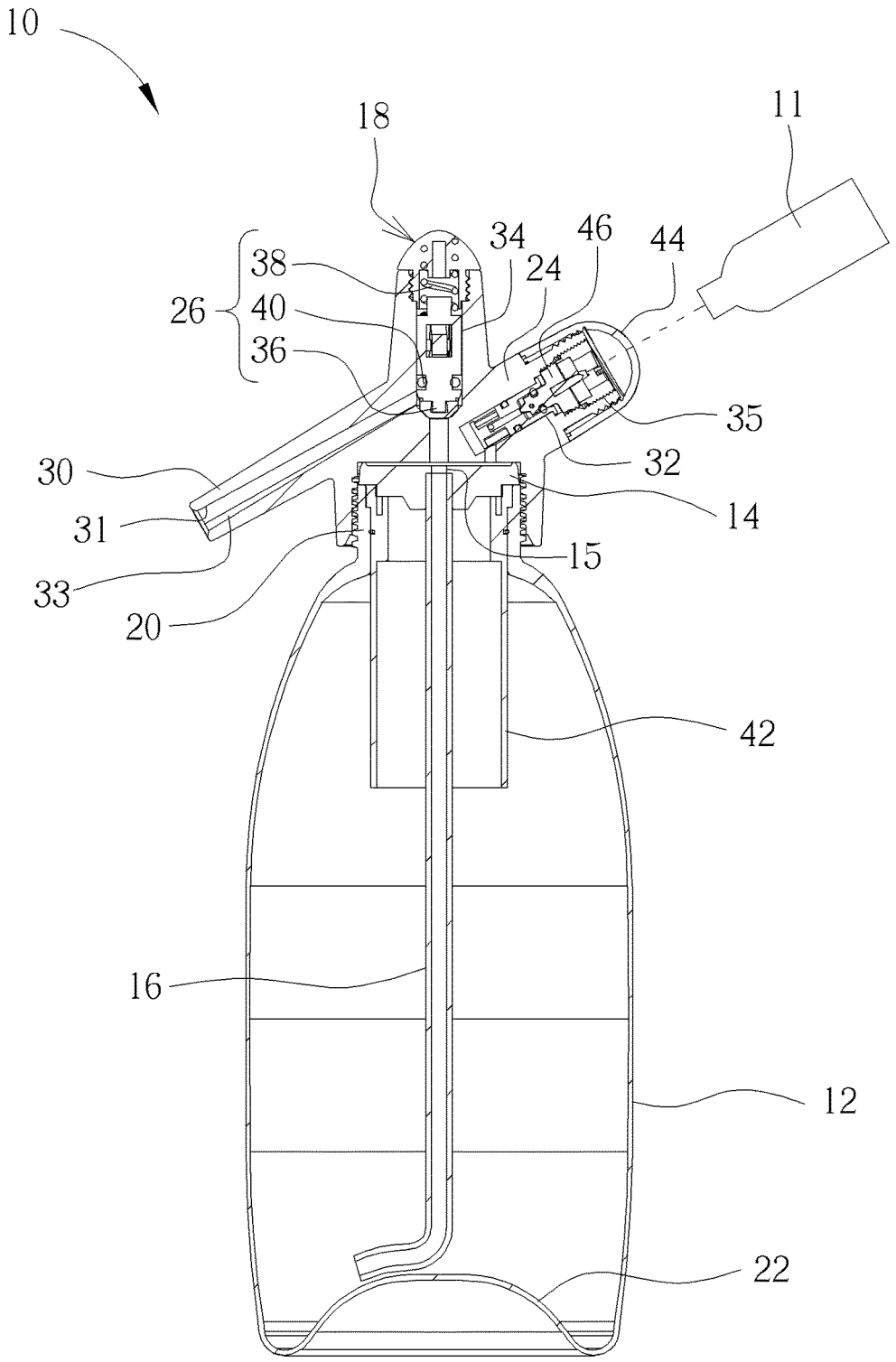
FIG. 4 is a sectional diagram of the bubble liquid bottle in FIG. 1 along a sectional line A-A.
Figure 5:
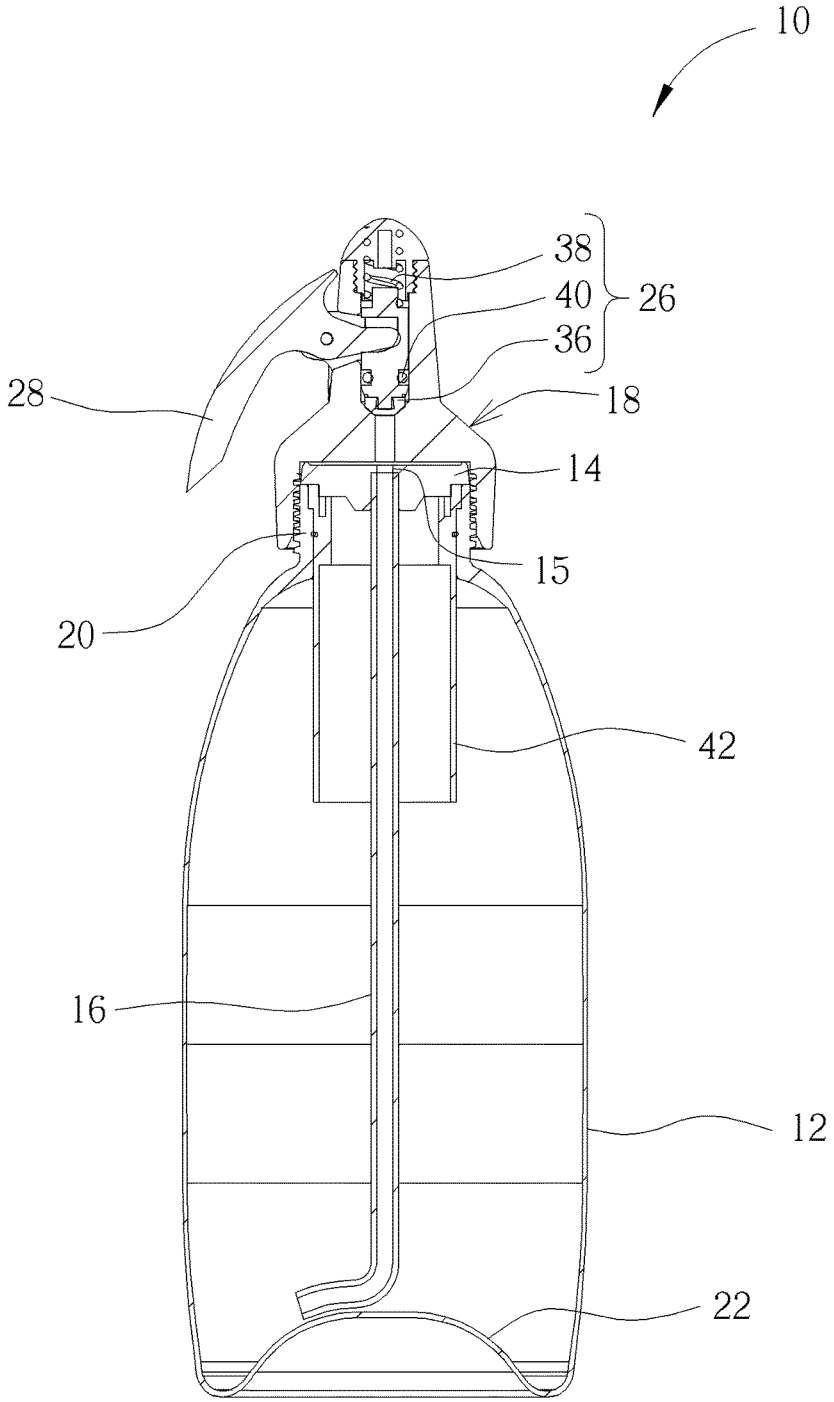
FIG. 5 is a sectional diagram of the bubble liquid bottle in FIG. 1 along a sectional line B-B.

Please refer to FIG. 1, FIG. 2, FIG. 3, FIG. 4, and FIG. 5. FIG. 1 is a front view of a bubble liquid bottle 10 according to an embodiment of the present invention. FIG. 2 is a side view of the bubble liquid bottle 10 in FIG. 1. FIG. 3 is an exploded diagram of the bubble liquid bottle 10 in FIG. 1. FIG. 4 is a sectional diagram of the bubble liquid bottle 10 in FIG. 1 along a sectional line A-A. FIG. 5 is a sectional diagram of the bubble liquid bottle 10 in FIG. 1 along a sectional line B-B. The bubble liquid bottle 10 could utilize its internal pressure generated by filling gas of a gas filling bottle to dissolve the gas in liquid contained therein temporarily for generating bubble liquid (e.g. soda water generated by dissolving carbon dioxide in water). As shown in FIGS. 1-5, the bubble liquid bottle 10 includes a bottle body 12, a pad 14, a straw 16, and a head 18. The bottle body 12 is preferably made of stainless steel material (e.g. SUS304 stainless steel, but not limited thereto) for containing liquid and has a mouth 20. In this embodiment, a bulge structure 22 is formed inwardly from a bottom of the bottle body 12 for dispersing the sustaining pressure that the bottle body 12 withstands. A diameter of the mouth 20 is preferably between 36 mm and 46 mm for allowing ice to directly enter the bottle body 12 through the mouth 20, so that a user could reduce temperature within the bubble liquid bottle 10 by directly adding ice for increasing the gas dissolving efficiency of the bubble liquid bottle 10. Furthermore, the aforesaid design is also advantageous to the inner surface coating process of the bubble liquid bottle 10, so as to improve the inner surface coating quality of the bubble liquid bottle 10. The pad 14 covers the mouth 20 and has a communication opening 15. The straw 16 is connected to the communication opening 15 and is inserted into the bottle body 12 for guiding bubble liquid generated in the bottle body 12 to flow through the communication opening 15.

More detailed description for the structural design of the head 18 is provided as follows. As shown in FIG. 1, FIG. 4, and FIG. 5, the head 18 covers the pad 14 and is preferably locked with the mouth 20 in a trapezoid-tooth engaging manner for achieving the hermetic purpose and efficiently preventing the head 18 from falling off the mouth 20 to cause unexpected danger during gas explosion of the bubble liquid bottle 10. In this embodiment, the head 18 could include a main body 24, a pressure-relief device 26, and a handle 28. The main body 24 could have an outlet channel 30, an inlet channel 32, and a communication channel 34. The outlet channel 30 is communicated with the communication opening 15 of the pad 14 via the communication channel 34. The inlet channel 32 is communicated with the communication opening 15 and is used for connecting to a gas filling bottle, so as to allow gas provided by the gas filling bottle to enter the bottle body 12 via the communication opening 15. The pressure-relief device 26 is disposed in the communication channel 34 and includes a stopper 36, an elastic member 38, and a ring 40. The stopper 36 is movably disposed in the communication channel 34. The elastic member 38 could be preferably a spring, but not limited thereto. The elastic member 38 is disposed in the communication channel 34 and abuts against the stopper 36. Accordingly, the elastic member 38 could be used for providing elastic force to drive the stopper 36 to block communication between the outlet channel 30 and the communication opening 15, so as to achieve the hermetic purpose. The ring 40 sleeves the stopper 36 and is located above the outlet channel 30 for preventing liquid or bubble liquid from overflowing out of the communication channel 34. That is, the blocking configuration of the ring 40 could make sure that liquid or bubble liquid could only flow out of the outlet channel 34 through the communication channel 34 instead of overflowing out of the head 18 along the communication channel 34, so as to efficiently prevent liquid leakage of the bubble liquid bottle 10. Furthermore, via the design in which the ring 40 is located above the outlet channel 30 so that the ring 40 would not be cut by the outlet channel 30, the present invention could also efficiently solve the prior art problem that the ring is cut off by the outlet channel during the pressure-relief function is executed. The handle 28 is pivoted to the main body 24 and is inserted into the stopper 36 (as shown in FIG. 5). In such a manner, when a user presses the handle 28, the handle 28 could push the stopper 36 to overcome the elastic force of the elastic member 38, so that the stopper 36 could move upward along the communication channel 34 to make the outlet channel 30 communicated with the communication opening 15. According to the siphon principle, bubble liquid generated in the bubble liquid bottle 10 could be driven by the internal pressure of the bottle body 15 to flow out of the outlet channel 30 through the straw 16, the communication opening 15, and the communication channel 34 for a user to drink. To be noted, the pad 14, the straw 16, and the main body 24 could be doped with antiseptics for solving the bacterial growth problem.

In practical application, for solving the problem that bubble liquid (or liquid) is accumulated in the outlet channel 30 due to its surface tension so that the accumulated bubble liquid would flow out of the outlet channel 30 frequently even when the bubble liquid bottle 10 is not used, a guiding slot 33 is concaved from an inner wall 31 of the outlet channel 30 to break the surface tension of the bubble liquid. Furthermore, as shown in FIG. 2, FIG. 4, and FIG. 5, the bubble liquid bottle 10 could further include a liquid level sleeve 42. The liquid level sleeve 42 is disposed through the mouth 20 and suspended in the bottle body 12. The straw 16 penetrates the liquid level sleeve 42 to be inserted into the bottle body 12. Accordingly, when a liquid level of liquid contained in the bottle body 12 is higher than a bottom of the liquid level sleeve 42, the liquid could be driven by the internal pressure of the bottle body 12 to flow into the liquid level sleeve 42 for indicating that the liquid contained in the bottle body 12 has reached to a predetermined safety capacity, so as to remind a user of stopping pouring liquid into the bottle body 12.

Furthermore, for preventing a gas filling bottle from providing the bubble liquid bottle 10 with an excessive filling pressure, a check valve could be additionally disposed in the bubble liquid bottle 10. For example, as shown in FIG. 4, the inlet channel 32 could have a connection opening 35, and the head 18 could further include a cover 44 and a check valve 46. The cover 44 is detachably connected to the connection opening 35. When the cover 44 is detached from the connection opening 35 and then a gas filling bottle is connected to the connection opening 35 to be communicated with the inlet channel 32, gas provided from the gas filling bottle could enter the bottle body 12 through the inlet channel 32, the communication opening 15, and the straw 16 and then dissolve in the liquid contained in the bottle body 12. During the aforesaid process, the check valve 46 could be disposed in the inlet channel 32 for blocking communication between the inlet channel 32 and the communication opening 15 to stop the gas filling bottle from filling gas into the bottle body 12 when the filling pressure of the gas filling bottle is greater than or equal to a predetermined value (e.g. 28 $Kg/cm^2$), so as to prevent the gas filling bottle from providing the bubble liquid bottle 10 with an excessive filling pressure. Accordingly, safety of the bubble liquid bottle 10 in use could be improved. As for description for the mechanical design of the check valve 46 and the related principle, it is commonly seen in the prior art and omitted herein.

Via the aforesaid designs, when a user wants to use the bubble liquid bottle 10 to generate bubble liquid, the user just needs to open the head 18 and then takes out the pad 14 and the straw 16, so that the user could pour liquid into the bottle body 12 through the mouth 20. Subsequently, the user could assemble the bottle body 12 with the pad 14, the straw 16, and the head 18 sequentially, detach the cover 44 from the connection opening 35, and then connect a gas filling bottle 11 (briefly depicted in FIG. 4) to the connection opening 35. In such a manner, gas provided from the gas filling bottle 11 could enter the bottle body 12 through the inlet channel 32, the communication opening 15, and the straw 16 and then dissolve in the liquid, so as to generate the bubble liquid. After completing the aforesaid process, the user could press the handle 28 to push the stopper 36 to overcome the elastic force of the elastic member 38, so that the stopper 36 could move upward along the communication channel 34 to make the outlet channel 30 communicated with the communication opening 15. According to the siphon principle, the bubble liquid generated in the bubble liquid bottle 10 could be driven by the internal pressure of the bottle body 12 to flow out of the outlet channel 30 through the straw 16, the communication opening 15, and the communication channel 34 for the user to drink. During the aforesaid process, if the internal pressure of the bottle body 12 is greater than a predetermined value (e.g. 30 $Kg/cm^2$), the stopper 36 could be driven by the internal pressure of the bottle body 12 to overcome the elastic force of the elastic member 38, so that the stopper 36 could move upward along the communication channel 34 to make the outlet channel 30 communicated with the communication opening 15 for generating the pressure-relief effect. On the other hand, when the internal pressure of the bottle body 12 is less than the predetermined value after the aforesaid pressure-relief process is performed, the elastic member 38 could drive the stopper 36 to block communication between the outlet channel 30 and the communication opening 15 again for generating the hermetic effect. To be noted, since the gas provided from the gas filling bottle 11 could enter the bottle body 12 through the inlet channel 32 and the communication opening 15 and the bubble liquid generated in the bubble liquid bottle 10 could flow out of the outlet channel 30 through the straw 16, the communication opening 15, and the communication channel 34, the bubble liquid bottle 10 of the present invention could further provide the gas-liquid separation function.

Compared with the prior art, the present invention adopts the design in which the ring located above the outlet channel would not be cut by the outlet channel and the stopper could be movably disposed in the communication channel to selectively block communication between the outlet channel and the communication opening or not, so as to efficiently solve the prior art problem that the ring could be cut off by the outlet channel during the pressure-relief function is executed. In such a manner, the bubble liquid bottle provided by the present invention could make sure that the pressure-relief device could still work well after performing the pressure-relief process many times, so as to greatly improve safety of the bubble liquid bottle in use.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A bubble liquid bottle comprising:

a bottle body having a mouth, the bottle body being used for containing liquid;

a pad covering the mouth of the bottle body and having a communication opening;

a straw connected to the communication opening and inserted into the bottle body; and a head disposed on the mouth and covering the pad, the head comprising:

a main body having an outlet channel, an inlet channel, and a communication channel, the outlet channel being communicated with the communication opening via the communication channel, the inlet channel being communicated with the communication channel and being used for connecting to a gas filling bottle so as to make gas provided by the gas filling bottle enter the bottle body via the communication opening and then dissolve in the liquid contained in the bottle body to generate a bubble liquid;

a pressure-relief device disposed in the communication channel, the pressure-relief device comprising:

a stopper movably disposed in the communication channel;

an elastic member disposed in the communication channel and abutting against the stopper for providing an elastic force to drive the stopper to block communication between the outlet channel and the communication opening; and a ring sleeving the stopper, the ring being located above the outlet channel for preventing the bubble liquid or the liquid from overflowing out of the communication channel; and a handle pivoted to the main body and inserted into the stopper for moving the stopper upward along the communication channel when the handle is pressed so as to make the bubble liquid driven by an internal pressure of the bottle body to flow out of the outlet channel through the straw, the communication opening, and the communication channel;

wherein when the internal pressure of the bottle body is greater than a first predetermined value, the stopper is driven to move upward by the internal pressure of the bottle body, so as to make the outlet channel communicated with the communication opening.

2. The bubble liquid bottle of claim 1, wherein the inlet channel has a connection opening, and the head further comprises:

a cover detachably connected to the connection opening, the gas provided by the gas filling bottle entering the bottle body via the communication opening and then dissolving in the liquid contained in the bottle body to generate the bubble liquid when the cover is detached from the connection opening and the gas filling bottle is then connected to the connection opening; and a check valve disposed in the inlet channel for blocking communication between the inlet channel and the communication opening when a filling pressure of the gas filling bottle is greater than or equal to a second predetermined value.

3. The bubble liquid bottle of claim 1, wherein a guiding slot is concaved from an inner wall of the outlet channel.

4. The bubble liquid bottle of claim 1 further comprising:

a liquid level sleeve disposed through the mouth and suspended in the bottle body, the straw penetrating the liquid level sleeve to be inserted into the bottle body, the liquid being driven by the internal pressure to flow into the liquid level sleeve when a level of the liquid is higher than a bottom of the liquid level sleeve.

5. The bubble liquid bottle of claim 1, wherein the head is locked with the mouth in a trapezoid-tooth engaging manner.

6. The bubble liquid bottle of claim 1, wherein a bulge structure is formed inwardly from a bottom of the bottle body.

7. The bubble liquid bottle of claim 1, wherein the liquid is water, and the gas is carbon dioxide.

8. The bubble liquid bottle of claim 1, wherein the bottle body is made of stainless steel material.

9. The bubble liquid bottle of claim 1, wherein a diameter of the mouth is between 36 mm and 46 mm.

10. The bubble liquid bottle of claim 1, wherein the pad, the straw, and the main body are doped with antiseptics.

* * * * *